United States Patent [19]
Vaittinen et al.

[11] Patent Number: 4,480,667
[45] Date of Patent: Nov. 6, 1984

[54] APPARATUS AND METHOD FOR REGULATING THE LENGTH OF WOOD CHIPS

[75] Inventors: Jorma Vaittinen; Seppo Könönen, both of Joensuu, Finland

[73] Assignee: S,A, Tervo Oy Karjalan Rautarakenne, Finland

[21] Appl. No.: 448,782

[22] Filed: Dec. 10, 1982

[30] Foreign Application Priority Data

Dec. 11, 1981 [FI] Finland ..... 813997

[51] Int. Cl.³ ..... B27L 11/00
[52] U.S. Cl. ..... 144/373; 144/176; 241/92
[58] Field of Search ..... 241/92; 144/162 R, 176, 144/185, 186, 373

[56] References Cited

U.S. PATENT DOCUMENTS 2,172,449 9/1939 Pelof et al. ..... 144/176 R
2,712,904 7/1955 Durkee ..... 144/176

*Primary Examiner*—W. D. Bray
*Attorney, Agent, or Firm*—Steinberg & Raskin

[57] ABSTRACT

The chipper includes an axially rotatable cutter disc having a frame plate and at least one cutting blade secured to the frame plate. At least one counterblade is axially spaced from the cutting blade. The length of the chips is adjusted by axially displacing a stop member relative to the cutting blade while the axial position of the cutting blade relative to the frame plate, and the relative position of the cutting blade and the counterblade remain unchanged.

7 Claims, 3 Drawing Figures

APPARATUS AND METHOD FOR REGULATING THE LENGTH OF WOOD CHIPS

BACKGROUND OF THE INVENTION

This invention relates to wood chippers and more particularly to an apparatus and method for regulating the length of wood chips. The invention also relates to a means for regulating the chip length of a wood chipper.

In presently known chipper devices of the non-adjustable category the chip length is constant. In other known chipper devices wherein the chip length can be regulated or adjusted a chipper blade or blade holder is displaced together with a counterblade in order to obtain a desired chip length. The known adjustable chipper devices are generally of complex construction and are difficult to adjust, giving rise to numerous instances of human error. As a result there are often inconsistencies in the chip quality which lead to increased costs in producing acceptable chips.

The adjustable chippers, wherein the chip length can be regulated, are often limited to a minor range of variation in chip length. Such range limits are usually a consquence of uniform chip quality requirements. Thus if an apparatus is capable of making chips with large lump sizes, it is unlikely that the same machine would be capable of producing uniform quality small grain chips. This problem is due to the requirement of a large passage between the cutting blade and the frame disc to permit admission of large chipped lumps. Consequently the adjustable chipping devices are commonly classified as fine grain chippers and lump chippers. A further problem with the known adustable chippers is that a desired change of chip length generally requires readjustment of the position of the cutting blades and the counterblade.

It is thus desirable to develop an improved chipping device which is capable of producing fine grain chips as well as chips with large lump sizes.

SUMMARY OF THE INVENTION

Accordingly it is an object of the invention to provide a new and improved apparatus and method for regulating chip length. Another object is to provide a chipping apparatus that is relatively simple to adjust, to yield fine grain chips or chips with large lump sizes.

A further object is to regulate chip length by means of an adjustment that does not require repositioning of the cutting blades or the counterblade, and which minimizes the possibility of human error.

In accordance with the present invention, the wood chipper apparatus comprises a rotatable cutter disc including at least one cutting blade and one counterblade spaced from the cutting blade. The cutter disc includes a frame plate and a stop member adjustably affixed to the frame plate. Thus the means for adjusting the length of the cut chips includes the stop member and means for displacing or locating the stop member in selected predetermined axial positions with respect to the cutting blade. The axial position of the cutting blade and the relative position between the cutting blade and the counterblade can remain unchanged.

Numerous alternatives may be used for fixing and adjusting elements, such as adjustment shims, adjustment washers, threaded screws, lock nuts, rods, lock washers, eccentrics, and springs.

Under such arrangement, the method for regulating the length of chips cut in the wood chipper includes rotating the cutter disc about a central axis with the cutter blade being mounted on the cutter disc for rotation therewith. The counterblade is positioned at a predetermined axial spacing from the cutter blade, and the stop member is axially spaced from the cutter blade in selected predetermined amounts by mounting the stop member on the cutter disc in an axially adjustable fashion with respect to the frame plate. In carrying out this method, the position of the cutting blade relative to the frame plate, and the relative spacing between the cutting blade and the counterblade are unchanged.

A remarkable advantage of this invention is that it enables fine grain chips and coarse lump chips to be produced with one chipper. Thus the chip length adjustment can be made in a comparatively short time without changing the positions of the cutting blade and the counterblade. Other features and advantages of the invention will be apparent from the following description.

DESCRIPTION OF THE DRAWING

A more complete appreciation of the present invention and many of the attendant advantages thereof will be readily understood by reference to the following detailed description when considered in connection with the accompanying drawing in which.

DESCRIPTION OF A PREFERRED EMBODIMENT

Figure 1:
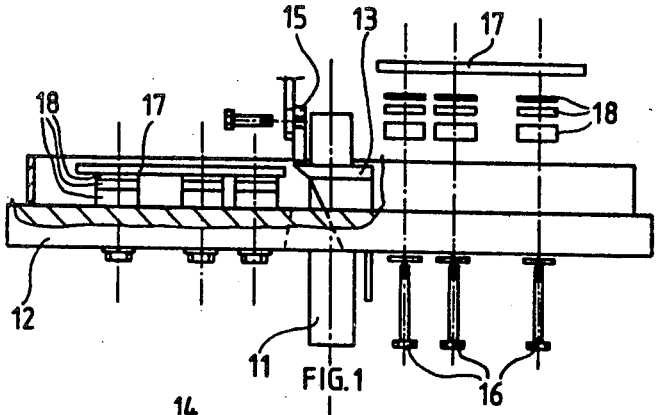
FIG. 1 is a side elevation partly shown in section and partly exploded of a wood chipper apparatus incorporating one embodiment of the present invention.
Figure 2:
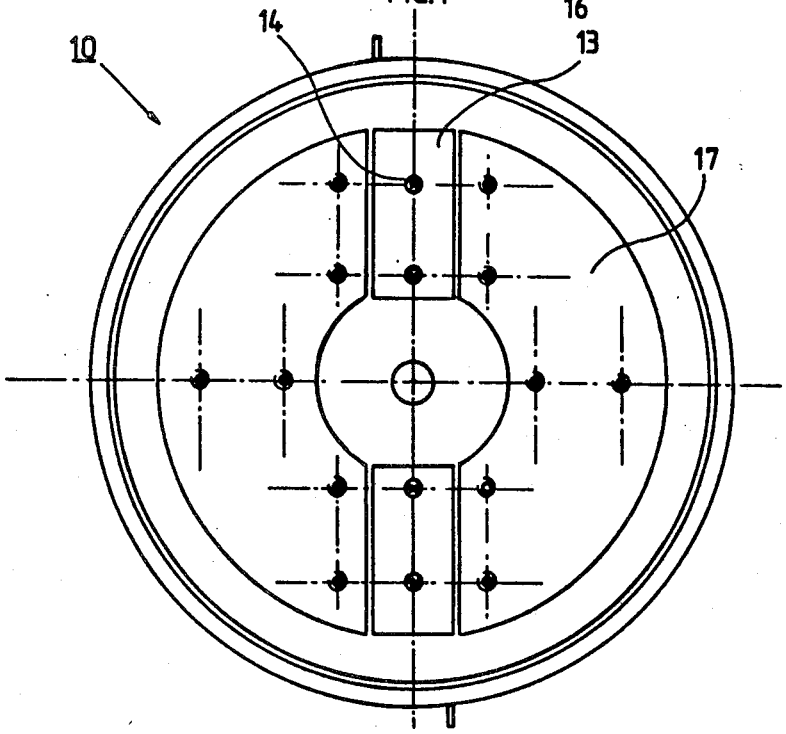
FIG. 2 is a top view thereof.

Referring now to the drawing, wherein like reference characters depict identical or corresponding parts throughout the several views, a chipper as depicted in FIGS. 1 and 2 comprises a cutter disc 10 having a shaft 11 to which a frame plate 12 is affixed by welding or other suitable known manner of securement. One or more cutting blades 13 are attached to the frame plate 12 by screws 14. Preferably such attachment of the cutting blades 13 to the frame plate 12 is of a permanent nature. The cutting blades 13 may be located outside the frame plate 12 or flush therewith. One or more stops 17 are affixed to the frame plate 12 by screws 16, for example. The stops 17 are disposed axially inward from the blade 13 an amount corresponding to the desired length of the chips.

As best seen in FIG. 1, the distance of the stop 17 from the cutting edge of the blade 13 is adjustable by means of an adjustment mechanism, which in this particular embodiment includes adjustment shims 18 and a screw 16.

Figure 3:
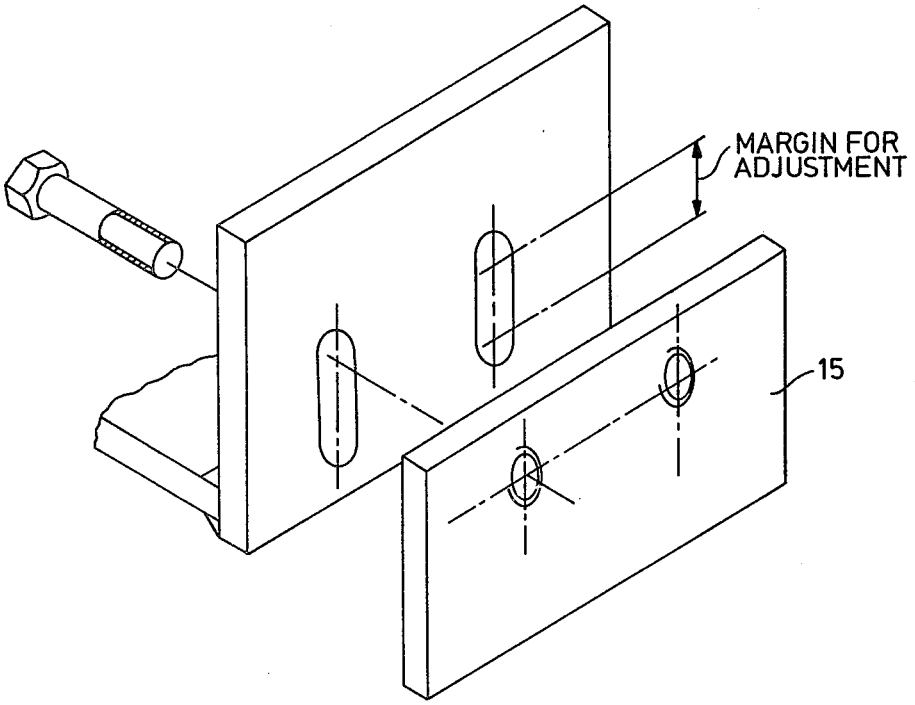
FIG. 3 is a perspective view illustrating possible adjustment of a blade on a wood chipper apparatus according to the present invention.

As the cutting blades 13 of the chipper are permanently mounted on the frame plate 12 by screws 14, the distance between the cutting blade 13 and the counterblade 15 is adjusted by displacing the counterblade 15 in the manner shown in FIGS. 1 and 3. Thus whenever the blade 13 and/or the counterblade 15 is worn during service, resulting in a change in the clearance between the blade 13 and the counterblade 15, a restoration of the original clearance can be obtained. The stops 17 are affixed to the frame plate 12 at a desired chip length distance from the cutting edge of the blade 13 using the adjustment shims 18. Thus the chip length adjustment capability of the invention and a consistent uniform chip quality is achieved because the distance between the blade 13 and the stop 17, which represents the through passage for the chips at the opposite side of the frame plate 12, remains at an optimum setting at all times within the entire extensive adjustment range.

What is claimed is:

1. A method for regulating the length of chips cut in a wood chipper comprising, rotating a cutter disc about a central axis, mounting a cutting blade on the cutter disc for rotation therewith, positioning a counterblade at a predetermined axial spacing from the cutting blade, axially spacing a stop member from the cutting blade selected predetermined amounts by mounting the stop member on the cutter disc so as to be axially adjustable with respect to a frame of the cutter disc while maintaining the position of the cutting blade and the relative axial spacing between the cutting blade and the counterblade unchanged.

2. A wood chipper apparatus comprising rotatable cutter means including at least one cutting blade and at least one counterblade spaced from said cutting blade, and means for adjusting the length of cut chips comprising at least one stop member displaceably secured to the rotatable cutter means, and means for displacing the stop member with respect to the cutting blade to adjust the length of the chips being cut while the position of the cutting blade and the relative position of the cutting blade and the counterblade remain unchanged.

3. The apparatus according to claim 2, wherein the displacement means comprises means for spacing said stop member selected predetermined amounts from said cutting blade.

4. The apparatus according to claim 3, wherein the cutter means comprise a cutter disc including a frame plate and said stop member is affixed to said frame plate.

5. The apparatus according to claim 4, wherein the means for spacing said stop member comprise shims disposed between said stop member and said frame plate.

6. The apparatus according to claim 4, wherein the cutting blade is affixed to said frame plate.

7. The apparatus according to claim 5, wherein two of said stop members are oppositely disposed and affixed to said frame plate, and two of said cutting blades are oppositely disposed and interposed between said stop members.

* * * * *